US010004925B2

(12) United States Patent
Tuffery

(10) Patent No.: US 10,004,925 B2
(45) Date of Patent: Jun. 26, 2018

(54) EMERGENCY FILTER SYSTEM FOR ENCAPSULATED SUIT

(75) Inventor: Swan Tuffery, Bouillargues (FR)

(73) Assignee: Honeywell International Inc., Morris Plains, NJ (US)

( * ) Notice: Subject to any disclaimer, the term of this patent is extended or adjusted under 35 U.S.C. 154(b) by 1510 days.

(21) Appl. No.: 13/278,439

(22) Filed: Oct. 21, 2011

(65) Prior Publication Data

US 2013/0097769 A1 Apr. 25, 2013

(51) Int. Cl.
*A62B 17/00* (2006.01)
*A62B 7/10* (2006.01)

(52) U.S. Cl.
CPC ..... *A62B 17/006* (2013.01); *A62B 7/10* (2013.01)

(58) Field of Classification Search
CPC .... A41D 13/02; A41D 13/001; A41D 13/015; A41D 27/28; A41D 13/0002; A41D 13/008; A41D 13/018; A41D 13/05; A41D 13/12; A41D 13/1209; A41D 13/1218; A41D 2400/52; A41D 31/0061; A41D 13/0005
USPC ..... 2/457, 458, 171.3, 82, 456, 2.17, 84, 81, 2/69
See application file for complete search history.

(56) References Cited

U.S. PATENT DOCUMENTS 2,991,000 A * 7/1961 Spees ..... 383/205
3,635,216 A 1/1972 Curtis
3,667,459 A 6/1972 Durney
3,802,594 A * 4/1974 Lemelson ..... 220/273
3,921,224 A 11/1975 Ingram, III
3,946,896 A * 3/1976 Lemelson ..... 220/273
4,059,852 A 11/1977 Crane
4,271,833 A 6/1981 Moretti
4,310,926 A 1/1982 Maroist
4,460,392 A * 7/1984 Poulsen et al. ..... 96/134
4,864,654 A * 9/1989 Schriver et al. ..... 2/84
4,901,370 A * 2/1990 Suda ..... 2/457
5,062,424 A 11/1991 Hooker
5,088,115 A * 2/1992 Napolitano ..... 2/69
5,201,309 A * 4/1993 Friberg et al. ..... 128/207.14
5,413,567 A * 5/1995 Barth et al. ..... 604/307
5,660,169 A * 8/1997 Kallstrand et al. ..... 128/203.15
5,991,921 A * 11/1999 Saito ..... 2/69
6,076,571 A * 6/2000 Burns et al. ..... 141/383
6,349,721 B1 * 2/2002 Grilliot et al. ..... 128/201.29
6,681,589 B2 1/2004 Brudnicki
(Continued)

FOREIGN PATENT DOCUMENTS

CA 2792282 A1 4/2013
CN 2730167 Y 10/2005
(Continued)

OTHER PUBLICATIONS

EP12188062, European Search Report dated Jan. 27, 2014, 2 pages.
(Continued)

*Primary Examiner* — Alissa L Hoey
*Assistant Examiner* — Catherine M Ferreira
(74) *Attorney, Agent, or Firm* — Wick Phillips Gould & Martin LLP

(57) ABSTRACT

An encapsulated protective suit having an external air flow hose and comprising a skin, a filter incorporated in the skin of the protective suit, and a seal, wherein when the seal is intact, air does not flow through the filter.

20 Claims, 5 Drawing Sheets

(56) References Cited

U.S. PATENT DOCUMENTS

| | | | | |
|---|---|---|---|---|
| 6,758,212 | B2 | 7/2004 | Swann | |
| 6,804,836 | B2 * | 10/2004 | Grilliot et al. | 2/455 |
| 7,631,364 | B2 * | 12/2009 | Culler et al. | 2/2.17 |
| 8,074,299 | B2 * | 12/2011 | Brookman | 2/243.1 |
| 8,464,366 | B2 * | 6/2013 | Carron | 2/455 |
| 8,476,604 | B2 * | 7/2013 | Yoder et al. | 250/482.1 |
| 9,000,913 | B2 | 4/2015 | Patil et al. | |
| 9,186,528 | B2 | 11/2015 | Patil et al. | |
| 2003/0045918 | A1 | 3/2003 | Turner et al. | |
| 2003/0140399 | A1 | 7/2003 | Golde | |
| 2003/0150232 | A1 | 8/2003 | Brudnicki | |
| 2003/0192103 | A1 * | 10/2003 | Avery et al. | 2/69 |
| 2004/0138601 | A1 * | 7/2004 | Chalmers | 602/41 |
| 2004/0216736 | A1 | 11/2004 | Lee et al. | |
| 2004/0226558 | A1 | 11/2004 | Kausch | |
| 2004/0237178 | A1 | 12/2004 | Landeros | |
| 2005/0010996 | A1 | 1/2005 | Steinert | |
| 2005/0011517 | A1 | 1/2005 | Steinert | |
| 2005/0015866 | A1 | 1/2005 | Steinert | |
| 2006/0048777 | A1 | 3/2006 | Brookman | |
| 2006/0070162 | A1 | 4/2006 | Frank | |
| 2007/0006607 | A1 | 1/2007 | Hunt | |
| 2007/0095088 | A1 | 5/2007 | Drobot Isherwood et al. | |
| 2007/0215148 | A1 | 9/2007 | Tuffery | |
| 2007/0289050 | A1 | 12/2007 | Nocente et al. | |
| 2008/0196140 | A1 | 8/2008 | Mayerson et al. | |
| 2009/0235439 | A1 * | 9/2009 | Cox et al. | 2/457 |
| 2010/0037891 | A1 | 2/2010 | Walker et al. | |
| 2012/0036622 | A1 | 2/2012 | Carron | |
| 2012/0066819 | A1 | 3/2012 | Carron | |
| 2012/0246809 | A1 | 10/2012 | Elam et al. | |
| 2013/0097769 | A1 | 4/2013 | Tuffery | |
| 2013/0112211 | A1 * | 5/2013 | Power et al. | 128/853 |
| 2013/0269090 | A1 | 10/2013 | Liu | |
| 2013/0276217 | A1 | 10/2013 | Patil et al. | |
| 2014/0184407 | A1 | 7/2014 | Patil et al. | |
| 2015/0033437 | A1 | 2/2015 | Hampton | |
| 2015/0250234 | A1 | 9/2015 | Tuffery et al. | |

FOREIGN PATENT DOCUMENTS

| | | | |
|---|---|---|---|
| CN | 1988936 | A | 6/2007 |
| CN | 101001672 | A | 7/2007 |
| CN | 103065698 | A | 4/2013 |
| DE | 10315607 | A1 | 12/2004 |
| EP | 056613 | A2 | 7/1982 |
| EP | 2583721 | B1 | 3/2017 |
| FR | 2899488 | A1 | 10/2007 |
| FR | 2941624 | A1 | 8/2010 |
| GB | 2401553 | B | 8/2005 |
| WO | WO 2006012475 | A2 * | 2/2006 |

OTHER PUBLICATIONS

U.S. Appl. No. 14/680,221 Office Action, dated Jun. 13, 2016, 20 pages.
RESPIREX International Ltd.; Airprotex FM; Product Data Sheet; Feb. 15, 2011; pp. 1-5.
PPS Professional Protection Systems; PPS Product Data Sheet; Nuclear Powered Respirator Suit (NuPo Suit); Paper No. L0041-080711; pp. 1-2.
EP12188062, European Search Report, dated Jan. 27, 2014, 2 pages.
EP12188062, Examination Report, dated Feb. 26, 2014, 5 pages.
EP14164775, Partial European Search Report,dated Aug. 7, 2014, 4 pages.
CN201210399325.2, Office Action, dated Oct. 27, 2016, 20 pages.
CN201210399325.2, Office Action, dated Mar. 10, 2016, 20 pages.
EP12188062, Intention to Grant, dated Nov. 2, 2016, 22 pages.
EP12188062, Decision to Grant, dated Feb. 16, 2017, 2 pages.
CN201210399325.2, Office Action, dated May 17, 2017, 5 pages.

* cited by examiner

EMERGENCY FILTER SYSTEM FOR ENCAPSULATED SUIT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Encapsulated protective suits may be worn in contaminated areas to protect the wearer of the suit. For example, workers may wear an encapsulated protective suit while working inside of a nuclear powered electrical generating plant or in the presence of radioactive materials. An encapsulated protective suit may be a one-time use type of system, wherein after a single use the suit is disposed of. An encapsulated protective suit may receive breathing air during normal operating conditions via an external air flow hose connected to the suit. The air may be supplied, for example, by a power air purifying respirator (PAPR) that may be carried by the user.

SUMMARY

In an embodiment, an encapsulated protective suit is disclosed. The encapsulated protective suit having an external air flow hose comprises a skin, a filter incorporated in the skin of the protective suit, and a seal, wherein when the seal is intact, air does not flow through the filter.

In an embodiment, an encapsulated protective suit is disclosed. The encapsulated protective suit having an external air flow hose comprises a skin, a filter incorporated in the skin of the protective suit, the filter having an exterior face and an interior face, where the exterior face of the filter faces towards an exterior of the protective suit and wherein the interior face of the filter faces towards an interior of the protective suit, a first seal coupled to one of the exterior of the suit or the exterior face of the filter, and a second seal coupled to one of the interior of the suit or the interior face of the filter.

In an embodiment, a method of using a fully encapsulated protective suit is disclosed. The method comprises donning a protective suit, the protective suit having an external air flow hose and comprising a skin, a filter incorporated in the skin of the protective suit, and a first seal, wherein when the first seal is intact, air does not flow out through the filter from an interior of the protective suit. The method further comprises, after donning the protective suit, breaching the first seal, and, after breaching the first seal, inhaling air received from the filter.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Figure 1:
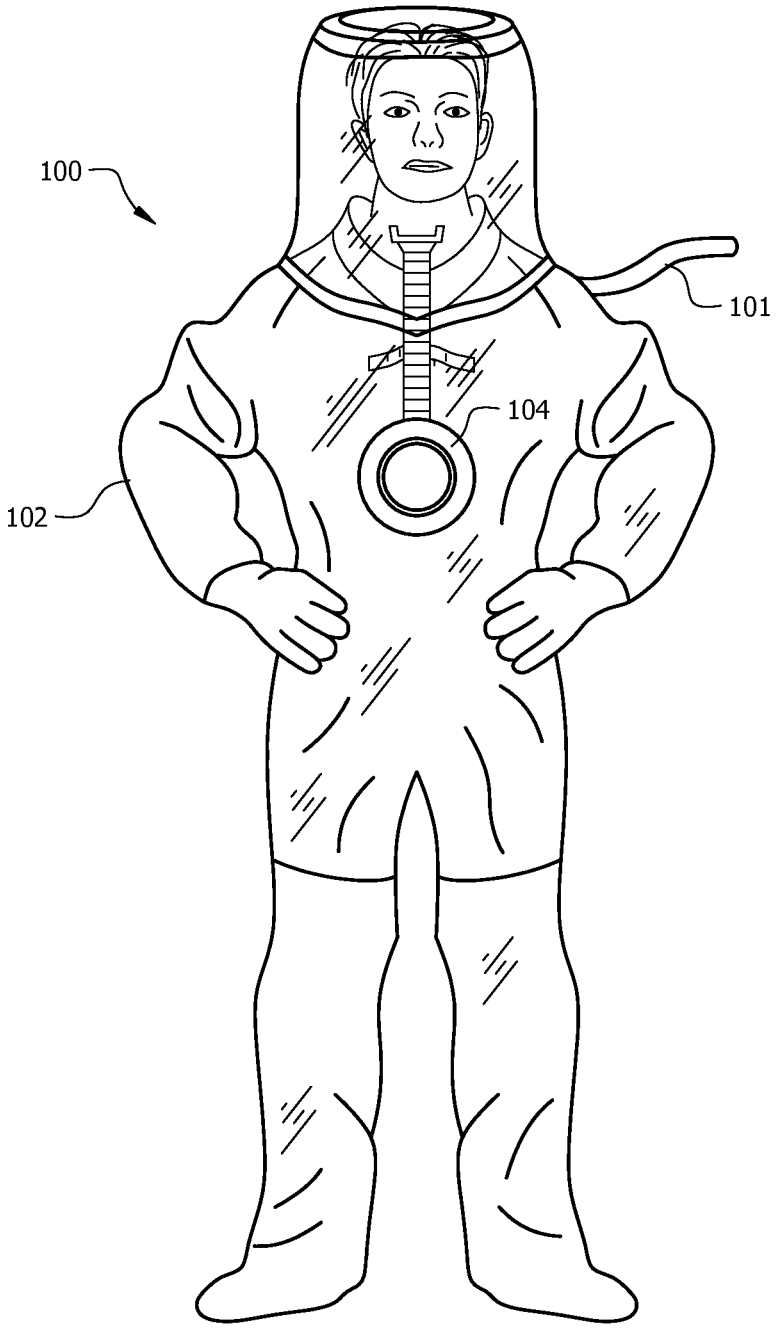
FIG. 1 illustrates an encapsulated protective suit according to an embodiment of the disclosure.

Turning now to FIG. 1, an encapsulated protective suit 100 is described. In an embodiment, the protective suit 100 having an external air flow hose 101, comprises a skin 102 and a first emergency breathing apparatus 104. In an alternative embodiment, the suit 100 may comprise a different emergency breathing apparatus. The user dons or puts on the suit 100 and may further don or put on booties, shoes, or boots on the feet to protect the integrity of the feet of the suit 100 and gloves to seal the suit 100 at the hands. The suit 100 may be a fully encapsulated protective suit. Air for breathing under normal operating conditions may be provided by an external air flow hose 101 coupled to the suit 100, for example an air flow hose 101 coupled to a powered air purifying respirator device (not shown), and air within the suit 100 is breathed by the user. In an embodiment, an exhaust valve (not shown) coupled to the suit 100 allows air to leave the suit, possibly maintaining an appropriate pressure differential. The suit 100 may be used in any contaminated environment, for example a workplace having radioactive materials and/or a nuclear powered electrical power generation facility. The suit 100 may be used as well in other contaminated environments. It is understood that in different embodiments the suit 100 may take different forms from that illustrated in FIG. 1. While illustrated as centered in FIG. 1, the first emergency breathing apparatus 104 may be offset to either side of a center of the suit 100 and/or moved up or down.

While using the suit 100 in the contaminated environment, an embodiment, it is preferred that a positive pressure differential be maintained between the interior and exterior of the suit 100. This positive pressure differential may provide a margin of safety, in that if a minor breach of the skin 102 occurs, contaminated material is not likely to enter the suit 100 but rather may be discouraged from entry by air flowing from the interior to the exterior of the suit 100 at the location of the minor breach. Generally it is desired that the suit 100 be relatively air-tight, with the exception of the exhaust valve described above, to promote efficiency. For example, if the normal air supply is provided by a powered air purifying respirator that is battery powered, a low efficiency encapsulated protective suit—that is a suit that has unnecessary air escape points—may cause the powered air purifying respirator to work harder to maintain the desired pressure differential and may prematurely discharge the battery. Alternatively, an inefficient suit may entail using a heavier battery in the powered air purification respirator and the disadvantages associated with excess weight.

When the powered air purifying respirator or other source of air flow fails, the user of the suit 100 may employ the first emergency breathing apparatus 104 to breathe safely. It is expected that the user of the suit 100, when normal air flow fails, will begin returning to a safe area shortly after the normal air flow source fails, and hence it is contemplated that the first emergency breathing apparatus 104 will be used for relatively short time intervals, for example for less than 2 minutes, for less than 6 minutes, or for less than 10 minutes.

Figure 2:
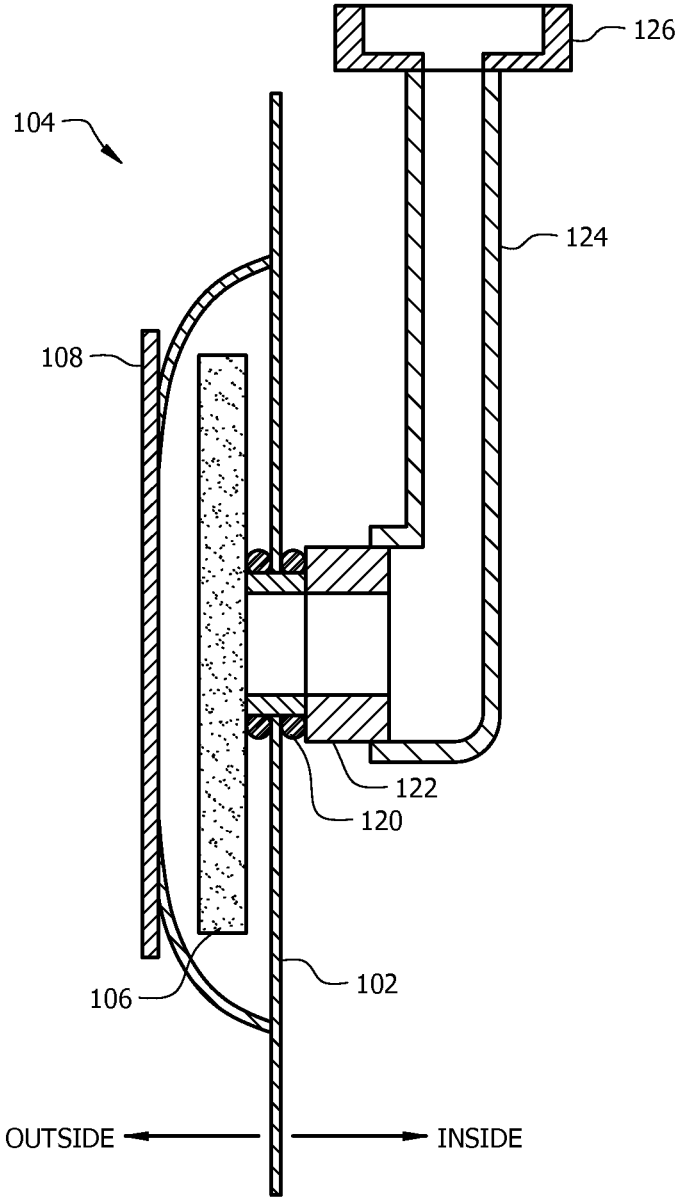
FIG. 2 illustrates an emergency air breathing apparatus for use with an encapsulated protective suit according to an embodiment of the disclosure.

Turning now to FIG. 2, the first emergency breathing apparatus 104 is discussed. In an embodiment, the first emergency breathing apparatus 104 comprises a filter 106, a seal 108, a filter coupling 120, a breathing pipe coupling 122, an breathing pipe 124, and a mouth piece 126. It is understood that the first emergency breathing apparatus 104 may comprise other components that are not illustrated or described herein. The first emergency breathing apparatus 104 and/or the filter 106 may be said to be incorporated into the skin 102 of the encapsulated protective suit 100. Additionally, the view presented in FIG. 2 is schematic and not intended to represent relative sizes or scales of the illustrated components. The inside of the encapsulated protective suit 100 is to the right of the skin 102 and the outside of the encapsulated protective suit 100 is to the left of the skin 102 as illustrated in FIG. 2. The outside of the encapsulated protective suit 100 may be referred to in some contexts as the exterior of the encapsulated protective suit 100 and the inside of the encapsulated protective suit 100 may be referred to in some contexts as the interior of the encapsulated protective suit 100.

Under normal operation, that is when the user of the encapsulated protective suit 100 is breathing air provided via an external air hose, the seal 108 blocks flow into and out of the filter 106. This blockage by the seal 108 contributes to the air-tightness of the suit 100 and promotes the efficiency of the suit 100. When emergency air supply is needed, the seal 108 is torn at least partially free of the skin 102 and/or free of the filter 106, opening a pathway for air to flow in through the filter 106, through the couplings 120, 122, up the breathing pipe 124, to the mouth piece 126. The portion of the filter 106 facing to the left in FIG. 2 may be referred to as an exterior face or an outside face of the filter 106; the portion of the filter 106 facing to the right in FIG. 2 may referred to as an interior face or an inside face of the filter 106.

In an embodiment, the filter 106 may be a pancake type filter. Pancake type filters are known in the art and may take a variety of different forms. In an embodiment, a pancake type filter may be substantially cylindrical in shape where the height of the cylinder is much less than the width or diameter of the cylinder. For example, in an embodiment, the height of the cylinder may be less than 20% of the width or diameter of the cylinder. Alternatively, in an embodiment, the height of the cylinder may be less than 10% of the width or diameter of the cylinder. While pancake filters may be generally circular in section, in an embodiment, the pancake filter may be polygonal in section or elliptical in section. In an embodiment, the filter 106 may be a P3 filter. Alternatively, in an embodiment, the filter 106 may be a P2 filter. Alternatively, in an embodiment, the filter 106 may be a P1 filter. As is known by one skilled in the art, a P3 filter may filter at least 99.95% of airborne particles; a P2 filter may filter at least 94% of airborne particles; and a P1 filter may filter at least 80% of airborne particles. In other embodiments, however, the filter 106 may be a different filter.

Figure 3A:
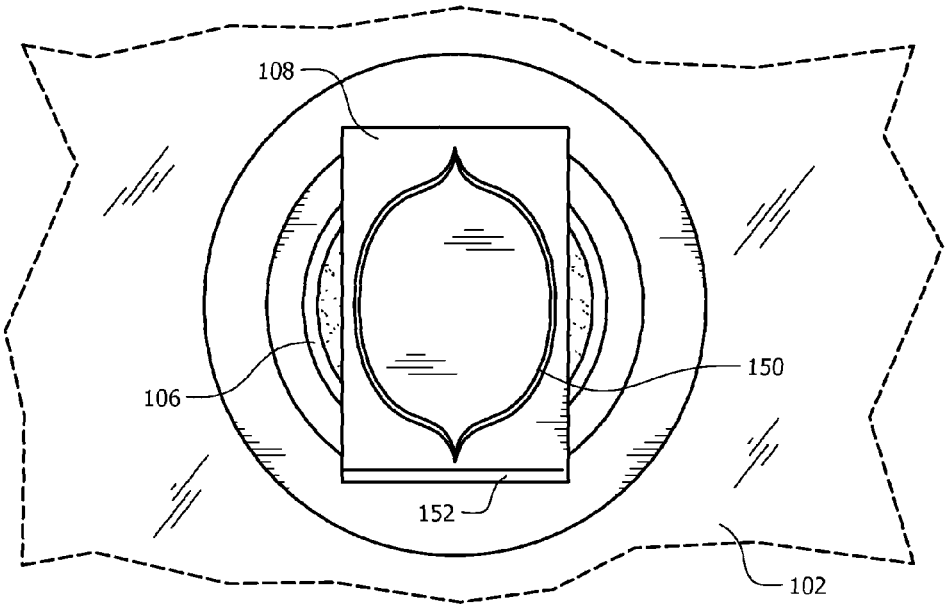
FIG. 3A illustrates a sealed air filter according to an embodiment of the disclosure.
Figure 3B:
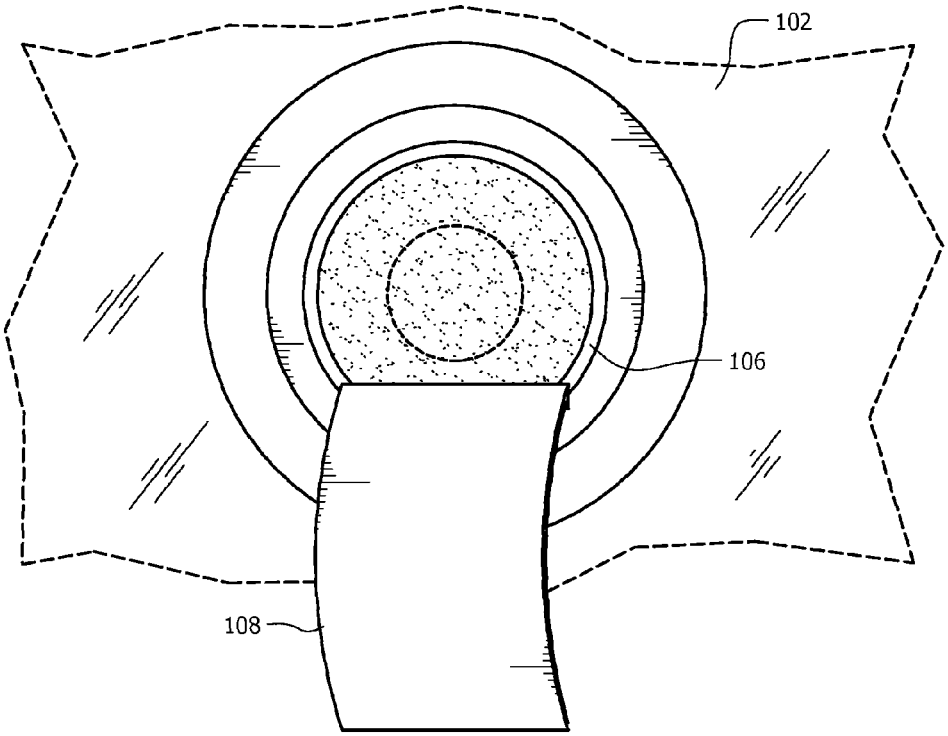
FIG. 3B illustrates an unsealed air filter according to an embodiment of the disclosure.

Turning now to FIG. 3A and FIG. 3B, further details related to the seal 108 and the filter 106 are described. In an embodiment, the seal 108 is secured in a sealing position by a tearable weld 150. In other embodiments, however, another means may be used to secure the seal 108, for example an adhesive. Tearable welds and non-tearable welds are generally known in the art. Without limitation, a tearable weld may be distinguished as being an attachment or coupling between two structures that yields or releases when a first one of the structures is pulled away from the second structure before either structure is damaged. By contrast, without limitation, a non-tearable weld may be distinguished as being an attachment or coupling between two structures such that damage to one of the structures is likely to occur if a first one of the structures is pulled away from the second structure before the non-tearable weld yields.

When the user of the encapsulated protective suit 100 wishes to use the first emergency breathing apparatus 104, the user may grasp the edge of the seal 108 and tear it downwards to breach the seal between the skin 102 and/or the filter 106 and the seal 108. It is understood that the term seal may be used to refer to the structure seal 108 that in part establishes a seal, meaning a barrier, between the exterior and interior of the suit 100 as well as to refer to the state of the existence of the barrier. When the seal 108 blocks flow into and out of the filter 106, the seal established between the seal 108 and the skin 102 and/or the filter 106 may be said to be intact. In an embodiment, the seal 108 may also be secured to the skin 102 and/or the filter 106 by a non-tearable weld 152 or other structure. As shown in FIG. 3B, when the seal 108 is torn free from the tearable weld 150 to open the first emergency breathing apparatus 104, the non-tearable weld 152 may retain the seal 108 coupled to the suit 100 so that the seal 108 is not separated. If the seal 108 were completely separated, it may fall and create a foreign material incident (FMI) in a contaminated area. In another embodiment, however, the seal 108 may not be retained by the non-tearable weld 152.

Figure 3C:
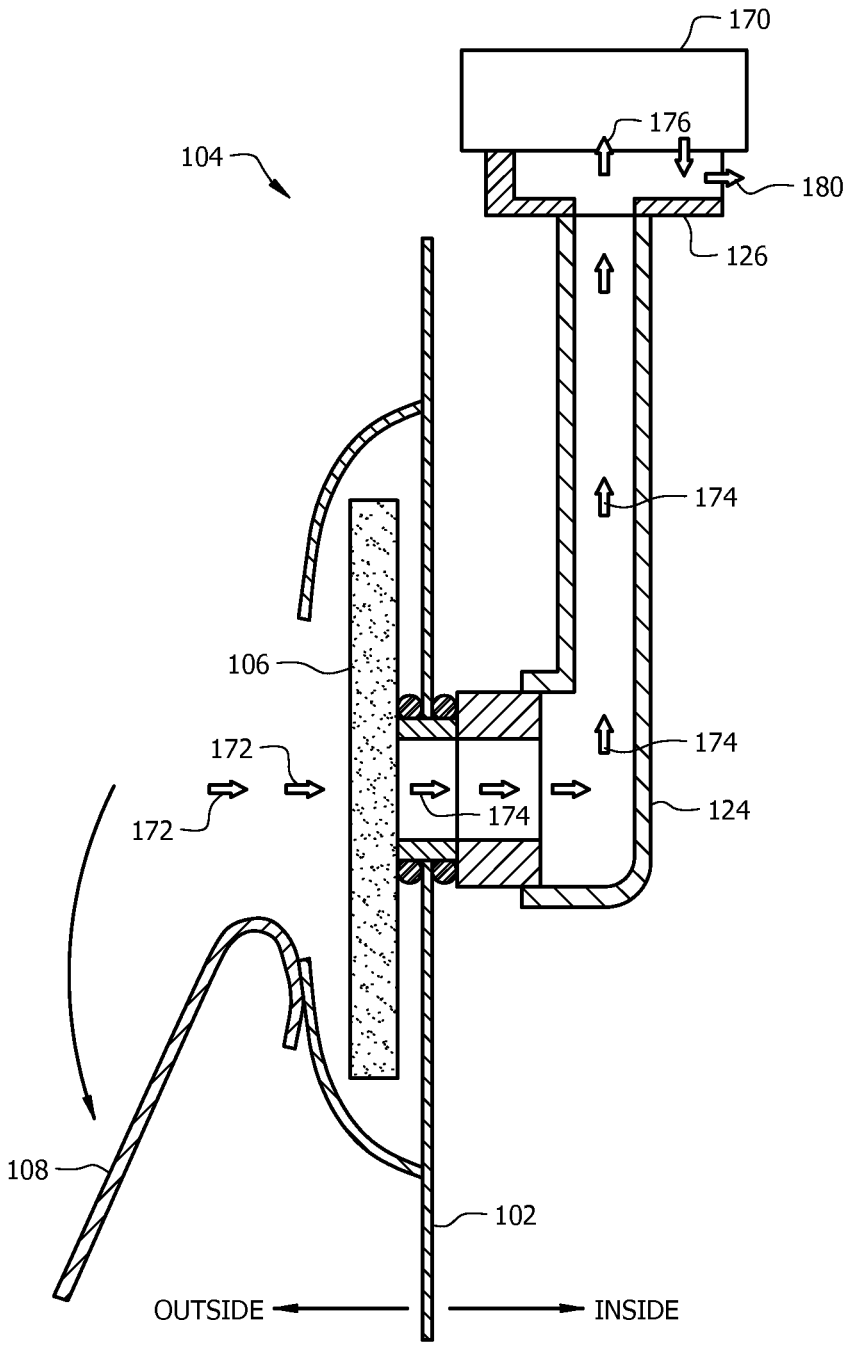
FIG. 3C illustrates an air flow of an emergency air breathing apparatus coupled to an encapsulated protective suit according to an embodiment of the disclosure.

Turning now to FIG. 3C, the flow of air using the first emergency breathing apparatus 104 is described. As illustrated in FIG. 3C, the seal 108 has been torn free from the tearable weld 150 and is retained by the non-tearable weld 152. Exterior air flow 172 enters the filter 106, breathing pipe air flow 174 proceeds through the breathing pipe 124 to the mouth piece 126 where emergency filtered air flow 176 is breathed by the user 170. The exhaled air flow 180 escapes from the mouth piece 126 either through an outflow valve or through user control of exhaled air. In an embodiment, a one-way air flow valve (not shown) may be incorporated in the first emergency breathing apparatus 104 to permit flow through the filter 106 from the outside to the inside, as illustrated in FIG. 3C, and to substantially block flow through the filter 106 from the inside of the suit 100 to the outside of the suit 100. The view presented in FIG. 3C is schematic and not intended to represent relative sizes or scales of the illustrated components.

Figure 4:
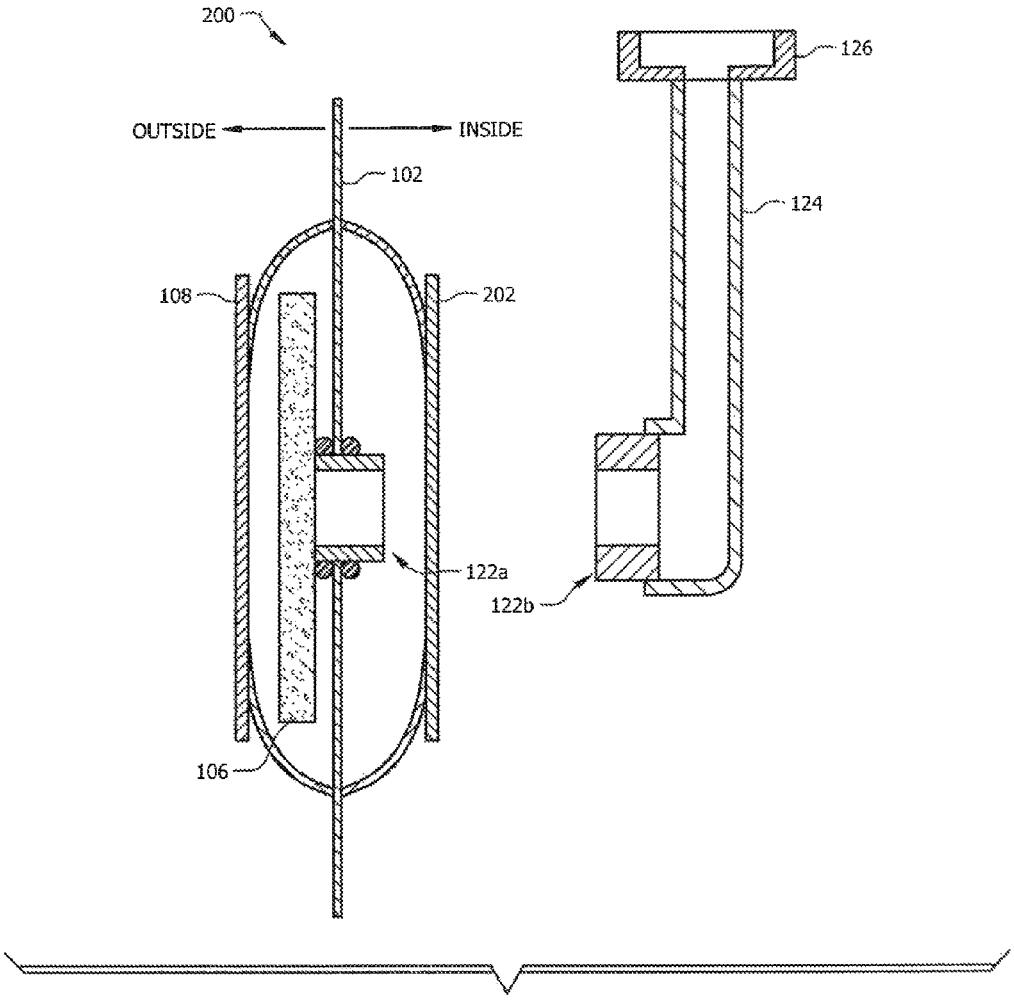
FIG. 4 illustrates an emergency air breathing apparatus for use with an encapsulated protective suit according to another embodiment of the disclosure.

Turning now to FIG. 4, a second emergency breathing apparatus 200 is described. Some of the features of the second emergency breathing apparatus 200 are substantially similar to those of the first emergency breathing apparatus 104 described above. The view presented in FIG. 4 is schematic and not intended to represent relative sizes or scales of the illustrated components.

The filter 106 used in the second emergency breathing apparatus 200 may be a moisture laden or moisture bearing filter. The principle of operation of the filter 106 used in the second breathing apparatus 200 may depend upon the moisture contained within the filter 106. For example, the filter 106 in the second breathing apparatus 200 may be a tritium filter. As is known to those skilled in the art, tritium is a radioactive isotope of hydrogen that may be encountered in nuclear reactor work environments and poses significant health risks to workers who may inhale tritium. To assure that the filter 106 in the second breathing apparatus 200 remains moist, the filter 106 may be sealed in the encapsulated protective suit 100 on both an exterior and interior of the suit 100. Thus, the seal 108 may be coupled to the exterior of the skin 102 and/or the exterior of the filter 106, and the seal 202 may be coupled to the interior of the skin 102 and/or the interior of the filter 106.

Before donning the encapsulated protective suit 100, a user may tear down the seal 202. After tearing down the seal 202, the user may couple the filter air coupler 122*a* with the breathing pipe air coupler 122*b*. Then when the user needs to employ the second emergency breathing apparatus 200, for example in an emergency breathing situation, the user tears open the seal 108 and breathes through the mouthpiece 126 as described above with reference to the first emergency breathing apparatus 104. In an embodiment, a one-way air flow valve (not shown) may be incorporated in the emergency breathing apparatus 200 to permit flow through the filter 106 from the outside of the suit 100 to the inside of the suit 100, and to substantially block flow through the filter 106 from the inside of the suit 100 to the outside of the suit 100.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An encapsulated protective suit, comprising:
an external air flow hose coupled to the suit;
a skin;
a filter incorporated in the skin of the protective suit; and
a seal, wherein when the seal is intact, air does not flow through the filter; and
wherein the seal is coupled by a tearable weld to one of an outside of the filter or an outside of the protective suit skin, wherein after tearable weld has been torn, air passes through the filter to an interior of the protective suit.

2. The suit of claim 1, wherein the seal is operable to be torn at least partially free of the skin of the suit or the filter to open a pathway for exterior air to flow through the filter into the protective suit.

3. The suit of claim 1, wherein the filter comprises a one-way air flow valve operable to permit flow through the filter from the exterior of the suit but to substantially block flow through the filter from the inside of the suit.

4. The suit of claim 1, wherein the seal is further coupled by a non-tearable weld to one of the outside of the filter or the outside of the protective suit, wherein after the tearable weld has been torn, the non-tearable weld retains the seal coupled to one of the outside of the filter or the outside of the protective suit, wherein a foreign material incident may be avoided.

5. The suit of claim 1, wherein the filter is a pancake-type filter.

6. The suit of claim 5, wherein the filter is a P3 filter.

7. The suit of claim 1, further comprising:
a mouth piece and
a breathing pipe coupled at one end to the filter and at a second end to the mouth piece.

8. An encapsulated protective suit, comprising:
an external air flow hose coupled to the suit;
a skin;
a filter incorporated in the skin of the protective suit, the filter having an exterior face and an interior face, where the exterior face of the filter faces towards an exterior of the protective suit and wherein the interior face of the filter faces towards an interior of the protective suit;
a first seal coupled by tearable weld to one of the exterior of the suit skin or the exterior face of the filter; and
a second seal coupled by tearable weld to one of the interior of the suit skin or the interior face of the filter.

9. The suit of claim 8, wherein the filter is moisture laden when both the first seal and the second seal are intact.

10. The suit of claim 8, wherein the filter is a tritium filter.

11. The suit of claim 8, wherein the suit is a one-time use suit.

12. The suit of claim 9 wherein when the first and second seals are intact, the filter is sealed to assure that the filter remains moist.

13. The suit of claim 8, wherein the first seal is further coupled by a non-tearable weld to one of the exterior of the suit or the exterior face of the suit, wherein when the tearable weld of the first seal is torn, the first seal is retained by the non-tearable weld.

14. A fully encapsulated protective suit operable to be coupled to a powered air purifying respirator by an air hose, comprising:
a protective suit skin; and
an emergency breathing apparatus comprising:
a filter incorporated in the skin of the protective suit;
a first seal, wherein when the first seal is intact, air does not flow out through the filter from an interior of the protective suit; and when the first seal is breached external air is received from the filter into the interior of the suit.

15. The suit of claim 14, wherein the first seal can be ripped at least partly free of the protective suit.

16. The suit of claim 15, further comprising a tearable weld coupled to the first seal and to the protective suit, wherein the first seal can be ripped at least partially free of the protective suit proximate the tearable weld.

17. The suit of claim 15, comprising a second seal, wherein the first seal is coupled to an exterior of the protective suit and the second seal is coupled to an interior of the protective suit, and wherein the second seal can be ripped at least partly free of the protective suit.

18. The suit of claim 17, further comprising a tearable weld coupled to the first seal and to the protective suit, wherein the first seal can be ripped at least partially free of the protective suit proximate the tearable weld.

19. The suit of claim 18, further comprising a breathing pipe and mouth piece coupled to the protective suit.

20. The suit of claim 1, wherein the filter is a pancake filter.

* * * * *